US006699115B2

(12) United States Patent
Osterheld et al.

(10) Patent No.: US 6,699,115 B2
(45) **Date of Patent: *Mar. 2, 2004**

(54) POLISHING PAD HAVING A GROOVED PATTERN FOR USE IN A CHEMICAL MECHANICAL POLISHING APPARATUS

(75) Inventors: Thomas H Osterheld, Mountain View, CA (US); Sen-Hou Ko, Sunnyvale, CA (US)

(73) Assignee: Applied Materials Inc., Santa Clara, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/330,876

(22) Filed: Dec. 27, 2002

(65) Prior Publication Data

US 2003/0092371 A1 May 15, 2003

Related U.S. Application Data

(63) Continuation of application No. 10/040,108, filed on Oct. 29, 2001, now Pat. No. 6,520,847, which is a continuation of application No. 09/441,633, filed on Nov. 16, 1999, which is a division of application No. 09/003,315, filed on Jan. 6, 1998, now Pat. No. 5,984,769, which is a continuation-in-part of application No. 08/856,948, filed on May 15, 1997, now Pat. No. 5,921,855.

(51) Int. Cl.[7] ..... B24D 11/00

(52) U.S. Cl. ..... 451/527; 529/550; 451/41

(58) Field of Search ..... 451/527, 550, 451/529, 59, 533, 539, 548

(56) References Cited

U.S. PATENT DOCUMENTS

| | | | | |
|---|---|---|---|---|
| 5,020,283 | A | 6/1991 | Tuttle | |
| 5,131,190 | A | 7/1992 | Gougouyan | |
| 5,177,908 | A | 1/1993 | Tuttle | |
| 5,190,568 | A | 3/1993 | Tselsin | |
| 5,216,843 | A | 6/1993 | Breivogel et al. | |
| 5,297,364 | A | 3/1994 | Tuttle | |
| 5,329,734 | A | 7/1994 | Yu | |
| 5,394,655 | A | 3/1995 | Allen et al. | |
| 5,421,769 | A | 6/1995 | Schultz et al. | |
| 5,489,233 | A | 2/1996 | Cook et al. | |
| 5,527,215 | A | 6/1996 | Rubino et al. | |
| 5,558,563 | A | 9/1996 | Cote et al. | |
| 5,578,362 | A | 11/1996 | Reinhardt et al. | |
| 5,645,469 | A | 7/1997 | Burke et al. | |
| 5,650,039 | A | 7/1997 | Talieh | |
| 5,778,481 | A | 7/1998 | Amsden et al. | |
| 5,888,121 | A | 3/1999 | Kirchner et al. | |
| 5,921,855 | A | 7/1999 | Osterheld et al. | |
| 6,520,847 | B2 * | 2/2003 | Osterheld et al. | 451/527 |

FOREIGN PATENT DOCUMENTS

| | | | |
|---|---|---|---|
| JP | 09-011119 | A | 1/1997 |

* cited by examiner

*Primary Examiner*—Joseph J. Hail, III
*Assistant Examiner*—Daniel Shanley
(74) *Attorney, Agent, or Firm*—Fish & richardson

(57) ABSTRACT

A polishing pad for a chemical mechanical polishing apparatus. The polishing pad includes a plurality of concentric circular grooves. The polishing pad may include multiple regions with grooves of different widths and spacings.

12 Claims, 14 Drawing Sheets

POLISHING PAD HAVING A GROOVED PATTERN FOR USE IN A CHEMICAL MECHANICAL POLISHING APPARATUS

CROSS-REFERENCE TO RELATED APPLICATIONS

This application is a continuation of pending U.S. application Ser. No. 10/040,108, filed Oct. 29, 2001 now U.S. Pat. No. 6,520,847 which is a continuation of pending U.S. application Ser. No. 09/441,633, filed Nov. 16, 1999, which is a divisional of U.S. application Ser. No. 09/003,315, filed Jan. 6, 1998, now issued as U.S. Pat. No. 5,984,769, which is continuation-in-part of U.S. application Ser. No. 08/856,948, filed May 15, 1997, now issued as U.S. Pat. No. 5,921,855, the entire disclosures of which are incorporated herein by reference.

BACKGROUND

The present invention relates generally to chemical mechanical polishing of substrates, and more particularly to a polishing pad having a grooved pattern for a chemical mechanical polishing apparatus.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. Therefore, there is a need to periodically planarize the substrate surface to provide a flat surface.

Chemical mechanical polishing (CMP) is one accepted method of planarization. This method typically requires that the substrate be mounted on a carrier or polishing head. The exposed surface of the substrate is then placed against a rotating polishing pad. The carrier head provides a controllable load, i.e., pressure, on the substrate to push it against the polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate. CMP is a fairly complex process, and it differs from simple wet sanding. In a CMP process, the reactive agent in the slurry reacts with the outer surface of the substrate to form reactive sites. The interaction of the polishing pad and abrasive particles with the reactive sites on the substrate results in polishing of the substrate.

An effective CMP process not only provides a high polishing rate, but also provides a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the CMP apparatus.

A recurring problem in CMP is non-uniformity of the polishing rate across the surface of the substrate. One source of this non-uniformity is the so-called "edge-effect", i.e., the tendency for the substrate edge to be polished at a different rate than the center of the substrate. Another source of non-uniformity is termed the "center slow effect", which is the tendency of center of the substrate to be underpolished. These non-uniform polishing effects reduce the overall flatness of the substrate and the substrate area suitable for integrated circuit fabrication, thus decreasing the process yield.

Another problem relates to slurry distribution. As indicated above, the CMP process is fairly complex, requiring the interaction of the polishing pad, abrasive particles and reactive agent with the substrate to obtain the desired polishing results. Accordingly, ineffective slurry distribution across the polishing pad surface provides less than optimal polishing results. Polishing pads used in the past have included perforations about the pad. These perforations, when filled, distribute slurry in their respective local regions as the polishing pad is compressed. This method of slurry distribution has limited effectiveness, since each perforation in effect acts independently. Thus, some of the perforations may have too little slurry, while others may have too much slurry. Furthermore, there is no way to directly channel the excess slurry to where it is most needed.

Another problem is "glazing" of the polishing pad. Glazing occurs when the polishing pad is heated and compressed in regions where the substrate is pressed against the pad. The peaks of the polishing pad are pressed down and the pits are filled up, so the polishing pad surface becomes smoother and less abrasive. As a result, the polishing time increases. Therefore, the polishing pad surface must be periodically returned to an abrasive condition, or "conditioned", to maintain a high throughput.

In addition, during the conditioning process, waste materials produced by conditioning the pad may fill or clog the perforations in the pad. Perforations clogged with such waste materials do not hold slurry effectively, thereby reducing the effectiveness of the polishing process.

An additional problem associated with filled or clogged pad perforations relates to the separation of the polishing pad from the substrate after polishing has been completed. The polishing process produces a high degree of surface tension between the pad and the substrate. The perforations decrease the surface tension by reducing the contact area between the pad and the substrate. However, as the perforations become filled or clogged with waste material, the surface tension increases, making it more difficult to separate the pad and the substrate. As such, the substrate is more likely to be damaged during the separation process.

Yet another problem in CMP is referred to as the "planarizing effect". Ideally, a polishing pad only polishes peaks in the topography of the substrate. After a certain period of polishing, the areas of these peaks will eventually be level with the valleys, resulting in a substantially planar surface. However, if a substrate is subjected to the "planarizing effect", the peaks and valleys will be polished simultaneously. The "planarizing effect" results from the compressible nature of the polishing pad in response to point loading. In particular, if the polishing pad is too flexible, it will deform and contact a large surface area of the substrate, including both the peaks and the valleys in the substrate surface.

Accordingly, it would be useful to provide a CMP apparatus which ameliorates some, if not all, of these problems.

SUMMARY

In one aspect, the invention is directed to a polishing pad for polishing a substrate in a chemical mechanical polishing apparatus. The polishing pad comprises a first polishing region having a first plurality of substantially circular concentric grooves with a first width and a first pitch, and a second polishing region surrounding the first polishing region and having a second plurality of substantially circular concentric grooves with a second width and a second pitch. At least one of the second width and second pitch differs from the first width and first pitch.

In another aspect, the polishing pad comprises a polishing surface having a first polishing region and a second polishing region surrounding the first polishing region, a spiral groove formed in the polishing surface, the spiral groove having a first pitch in the first polishing region and a second, different pitch in the second polishing region.

In another aspect, the polishing pad comprises a first polishing region having a first plurality of substantially circular concentric grooves, and a second polishing region surrounding the first polishing region and having a plurality of substantially serpentine grooves.

In another aspect, the polishing pad comprises a first polishing region having a first plurality of substantially circular concentric grooves, and a second polishing region surrounding the first polishing region and having a second plurality of substantially circular concentric grooves. A center of the second plurality of concentric grooves is offset from a center of the first plurality of concentric grooves.

In another aspect, the polishing pad comprises a first polishing region having a first plurality of substantially circular concentric grooves, and a second polishing region surrounding the first polishing region and having a plurality of groove arc segments. The groove arc segments are disposed along concentric circular paths such that each groove arc segment does not radially overlap a groove arc segment on an adjacent path.

In another aspect, the polishing pad comprises a first polishing region having a first plurality of substantially circular concentric grooves, and a second polishing region surrounding the first polishing region and having a spiral groove.

Implementations of the invention may include the following. Each groove may have a depth of at least about 0.02 inches, a width of at least about 0.015 inches, and a pitch of at least about 0.09 inches. A third polishing region may surround the second polishing region and have substantially circular concentric grooves. The width and pitch of the grooves in the third region may be equal to the width and pitch of the grooves in the first region. The pitch of the groove or grooves in the first region may be different, e.g., larger, than the pitch of the groove or grooves in the second region. The width of the groove or grooves in the first region may be different, e.g., smaller, than the pitch of the groove or grooves in the second region. Specifically, the first pitch may be about two times larger than the second pitch, and the second width may be about six times greater than the first width. The grooves in the first region may cover about 25% of the surface area of the first region, and the grooves in the second region may cover about 50% of the surface area of the second region. The spiral groove may have a uniform width. The serpentine grooves may have a pitch between about one and two times their amplitude, or between about one-and-one-half and two times their width. The grooves in the second region may have a width of about 0.125 inches and a pitch of about 0.2 inches. The serpentine groove may have an amplitude between about 0.2 and 0.4 inches. The center of the first plurality of circular grooves may be offset from the center of the second plurality of circular grooves by a distance approximately equal to a pitch of the second plurality of grooves. The grooves in the third region may be concentric with the grooves in the first region.

Advantages of the invention include the following. The polishing pad provides improved polishing uniformity. The grooves of the polishing pad provide an effective way to distribute slurry across the pad. The grooves are sufficiently wide that waste material produced by the conditioning process can be flushed from the grooves. The polishing pad is sufficiently rigid to avoid the "planarizing effect". The polishing pad's relatively deep grooves also improve the pad lifetime.

Other features and advantages will be apparent from the following description, including the drawings and claims.

DETAILED DESCRIPTION

Figure 1:
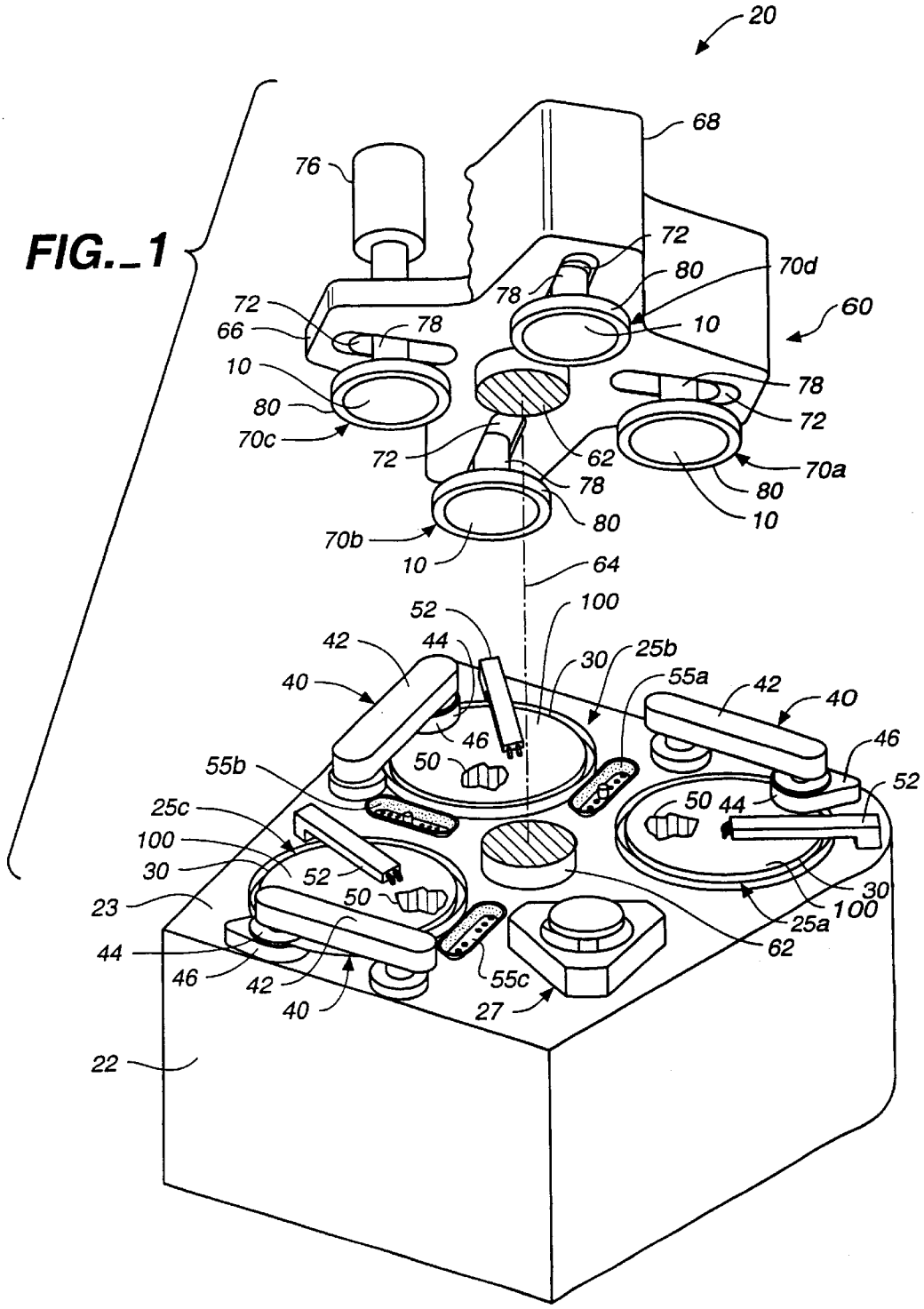
FIG. 1 is a schematic exploded perspective view of a chemical mechanical polishing apparatus.

Referring to FIG. 1, one or more substrates 10 will be polished by a chemical mechanical polishing apparatus 20. A complete description of polishing apparatus 20 may be found in U.S. patent application Ser. No. 08/549,336, entitled RADIALLY OSCILLATING CAROUSEL PROCESSING SYSTEM FOR CHEMICAL MECHANICAL POLISHING, filed Oct. 27, 1995 by Ilya Perlov, et al., and assigned to the assignee of the present invention, the entire disclosure of which is incorporated herein by reference. Polishing apparatus 20 includes a lower machine base 22 with a table top 23 mounted thereon and a removable outer cover (not shown). Table top 23 supports a series of polishing stations 25*a,* 25*b* and 25*c,* and a transfer station 27. Transfer station 27 forms a generally square arrangement with the three polishing stations 25*a,* 25*b* and 25*c.* Transfer station 27 serves multiple functions, including receiving individual substrates 10 from a loading apparatus (not shown), washing the substrates, loading the substrates into carrier heads (to be described below), receiving the substrates from the carrier heads, washing the substrates again, and finally, transferring the substrates back to the loading apparatus.

Each polishing station includes a rotatable platen 30 on which is placed a polishing pad 100. If substrate 10 is an "eight-inch" (200 millimeter) or "twelve-inch" (300 millimeter) diameter disk, then platen 30 and polishing pad 100 will be about twenty inches in diameter. Platen 30 may be a rotatable aluminum or stainless steel plate connected to a platen drive motor (not shown). For most polishing processes, the platen drive motor rotates platen 30 at thirty to two hundred revolutions per minute, although lower or higher rotational speeds may be used.

Each polishing station 25*a*–25*c* may further include an associated pad conditioner apparatus 40. Each pad conditioner apparatus 40 has a rotatable arm 42 holding an independently-rotating conditioner head 44 and an associated washing basin 46. The conditioner apparatus maintains the condition of the polishing pad so it will effectively polish any substrate pressed against it while it is rotating.

A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of polishing pad 100 by a combined slurry/rinse arm 52. The slurry/rinse arm may include two or more slurry supply tubes to provide slurry to the surface of the polishing pad. Sufficient slurry is provided to cover and wet the entire polishing pad 100. Slurry/rinse arm 52 also includes several spray nozzles (not shown) which provide a high-pressure rinse of polishing pad 100 at the end of each polishing and conditioning cycle.

Two or more intermediate washing stations 55*a* and 55*b* may be positioned between neighboring polishing stations 25*a,* 25*b* and 25*c.* The washing stations rinse the substrates as they pass from one polishing station to another.

A rotatable multi-head carousel 60 is positioned above lower machine base 22. Carousel 60 is supported by a center post 62 and is rotated thereon about a carousel axis 64 by a carousel motor assembly located within base 22. Center post 62 supports a carousel support plate 66 and a cover 68. Carousel 60 includes four carrier head systems 70*a,* 70*b,* 70*c,* and 70*d.* Three of the carrier head systems receive and hold substrates, and polish them by pressing them against polishing pads 100 on platens 30 of polishing stations 25*a*–25*c.* One of the carrier head systems receives a substrate from and delivers a substrate to transfer station 27.

The four carrier head systems 70*a*–70*d* are mounted on carousel support plate 66 at equal angular intervals about carousel axis 64. Center post 62 allows the carousel motor to rotate carousel support plate 66 and to orbit carrier head systems 70*a*–70*d* and the substrates attached thereto about carousel axis 64.

Each carrier head system 70*a*–70*d* includes a carrier or carrier head 80. Each carrier head 80 independently rotates about its own axis. A carrier drive shaft 74 connects a carrier head rotation motor 76 (shown by the removal of one quarter of cover 68) to carrier head 80. There is one carrier drive shaft and motor for each head. In addition, each carrier head 80 independently laterally oscillates in a radial slot 72 formed in carousel support plate 66. A slider (not shown) supports each drive shaft 74 in radial slot 72. A radial drive motor (not shown) may move the slider to laterally oscillate the carrier head.

The carrier head 80 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

Figure 2:
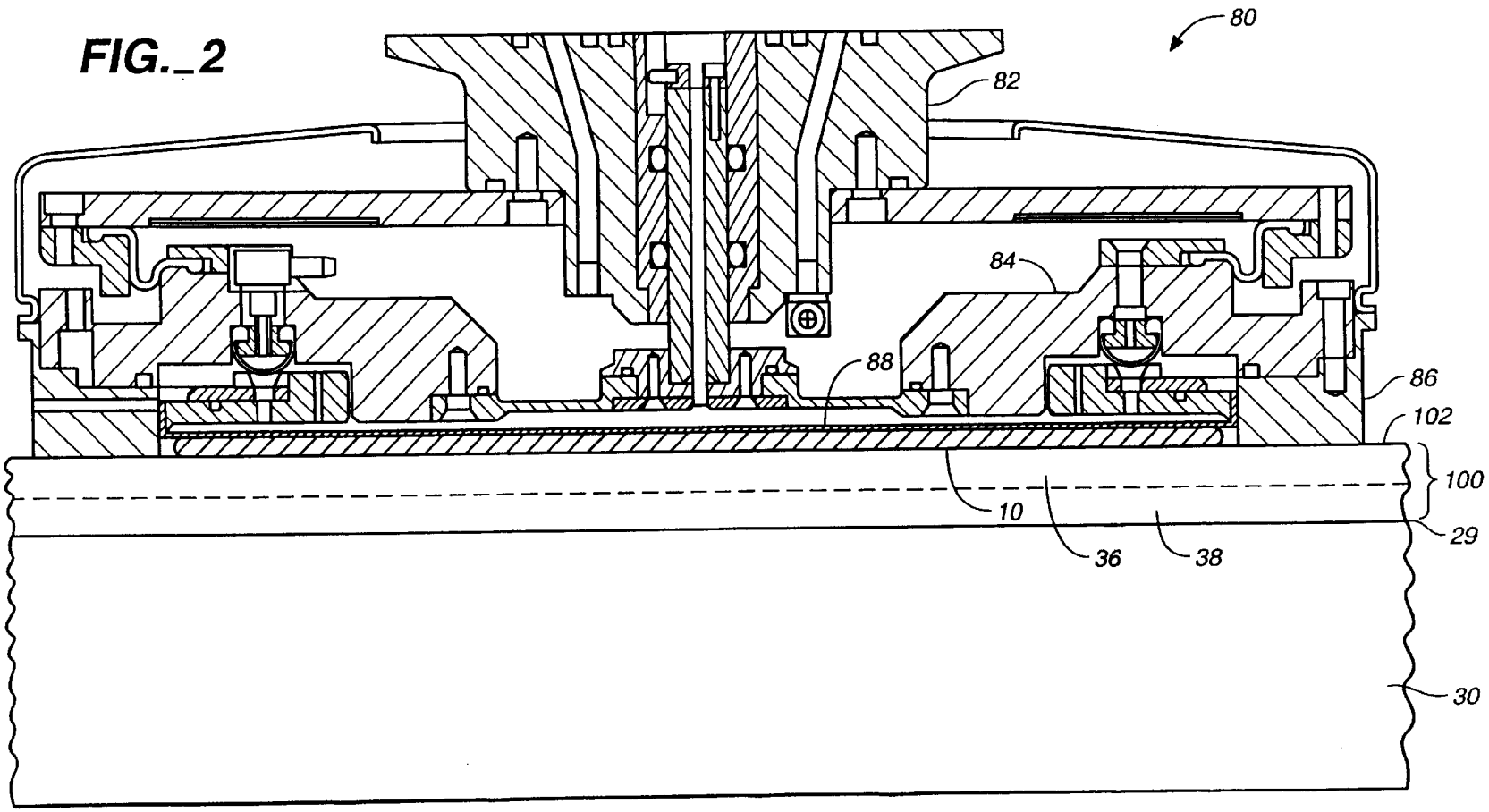
FIG. 2 is a schematic cross-sectional view of a carrier head and a polishing pad.

Referring to FIG. 2, each carrier head 80 includes a housing assembly 82, a base assembly 84 and a retaining ring assembly 86. A loading mechanism may connect base assembly 84 to housing assembly 82. The base assembly 84 may include a flexible membrane 88 which provides a substrate receiving surface for the carrier head. A description of carrier head 80 may be found in U.S. patent application Ser. No. 08/745,679, entitled A CARRIER HEAD WITH A FLEXIBLE MEMBRANE FOR A CHEMICAL MECHANICAL POLISHING SYSTEM, filed Nov. 8, 1996, by Steven M. Zuniga et al., assigned to the assignee of the present invention, the entire disclosure of which is incorporated herein by reference.

Polishing pad 100 may comprise a composite material having a roughened polishing surface 102. Polishing pad 100 may have an upper layer 36 and a lower layer 38. Lower layer 38 may be attached to platen 30 by a pressure-sensitive adhesive layer 39. Upper layer 36 may be harder than lower layer 38. Upper layer 36 may be composed of polyurethane or polyurethane mixed with a filler. Lower layer 38 may be composed of compressed felt fibers leached with urethane. A two-layer polishing pad, with the upper layer composed of IC-1000 and the lower layer composed of SUBA-4, is available from Rodel, Inc. of Newark, Del. (IC-1000 and SUBA-4 are product names of Rodel, Inc.).

Figure 3:
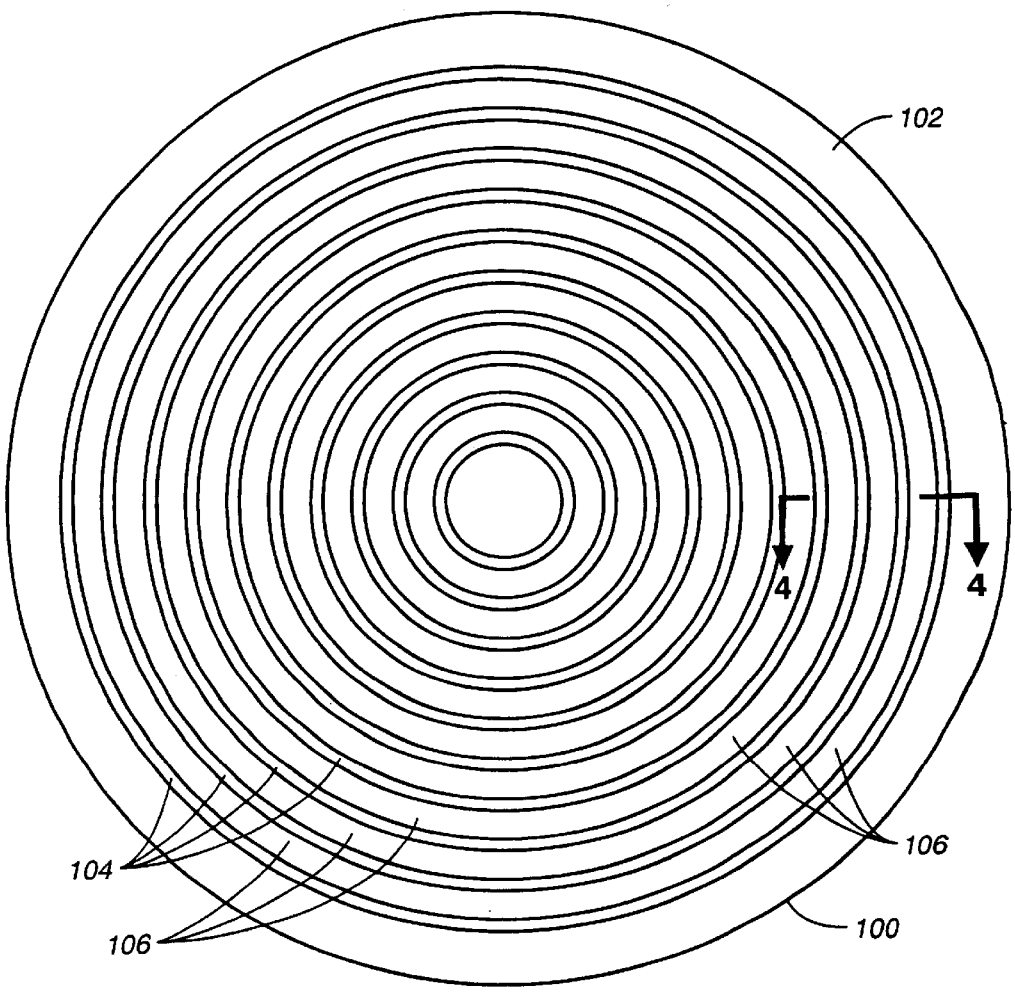
FIG. 3 is a schematic top view of a polishing pad having concentric circular grooves.
Figure 4:
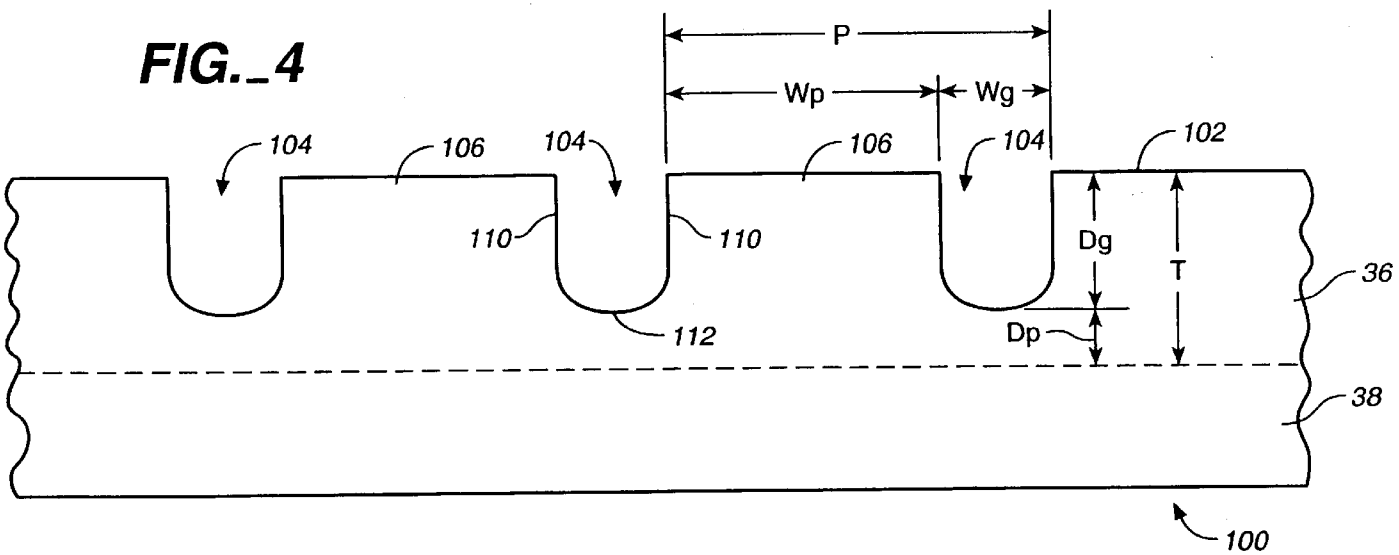
FIG. 4 is a schematic cross-sectional view of the polishing pad of FIG. 3 along line 4—4.

Referring to FIGS. 3 and 4, a plurality of concentric circular grooves 104 are disposed in polishing surface 102 of polishing pad 100. Advantageously, these grooves are uniformly spaced with a pitch P. The pitch P, as shown mostly clearly by FIG. 4, is the radial distance between adjacent grooves. Between each groove is an annular partition 106 having a width Wp. Each groove 104 includes walls 110 which terminate in a substantially U-shaped base portion 112. Each groove may have a depth Dg and a width Wg. Alternately, the grooves may have a rectangular cross-section.

The walls 110 may be generally perpendicular and terminate at U-shaped base 112. Each polishing cycle results in wear of the polishing pad, generally in the form of thinning of the polishing pad as polishing surface 102 is worn down. The width Wg of a groove with substantially perpendicular walls 110 does not change as the polishing pad is worn. Thus, the generally perpendicular walls ensure that the polishing pad has a substantially uniform surface area over its operating lifetime.

The various embodiments of the polishing pad include wide and deep grooves in comparison to those used in the past. The grooves 104 have a minimum width Wg of about 0.015 inches. Each groove 104 may have a width Wg between about 0.015 and 0.04 inches. Specifically, the grooves may have a width Wg of approximately 0.020 inches. Each partition 106 may have a width Wp between about 0.075 and 0.20 inches. Specifically, the partitions may have a width Wp of approximately 0.10 inches. Accordingly, the pitch P between the grooves may be between about 0.09 and 0.24 inches. Specifically, the pitch may be approximately 0.12 inches.

The ratio of groove width Wg to partition width Wp may be selected to be between about 0.10 and 0.25. The ratio may be approximately 0.2. If the grooves are too wide, the polishing pad will be too flexible, and the "planarizing effect" will occur. On the other hand, if the grooves are too narrow, it becomes difficult to remove waste material from the grooves. Similarly, if the pitch is too small, the grooves will be too close together and the polishing pad will be too flexible. On the other hand, if the pitch is too large, slurry will not be evenly transported to the entire surface of the substrate.

The grooves 104 also have a depth Dg of at least about 0.02 inches. The depth Dg may be between about 0.02 and 0.05 inches. Specifically, the depth Dg of the grooves may be approximately 0.03 inches. Upper layer 36 may have a thickness T between about 0.06 and 0.12 inches. As such, the thickness T may be about 0.07 inches. The thickness T should be selected so that the distance Dp between the bottom of base portion 112 and lower layer 38 is between about 0.035 and 0.085 inches. Specifically, the distance Dp may be about 0.04 inches. If the distance Dp is too small, the polishing pad will be too flexible. On the other hand, if the distance Dp is too large, the polishing pad will be thick and, consequently, more expensive. Other embodiments of the polishing pad may have grooves with a similar depth.

Referring to FIG. 3, grooves 104 form a pattern defining a plurality of annular islands or projections. The surface area presented by these islands for polishing is between about 90% and 75% of the total surface area of polishing pad 100. As a result, the surface tension between the substrate and the polishing pad is reduced, facilitating separation of the polishing pad from the substrate at the completion of a polishing cycle.

Figure 5:
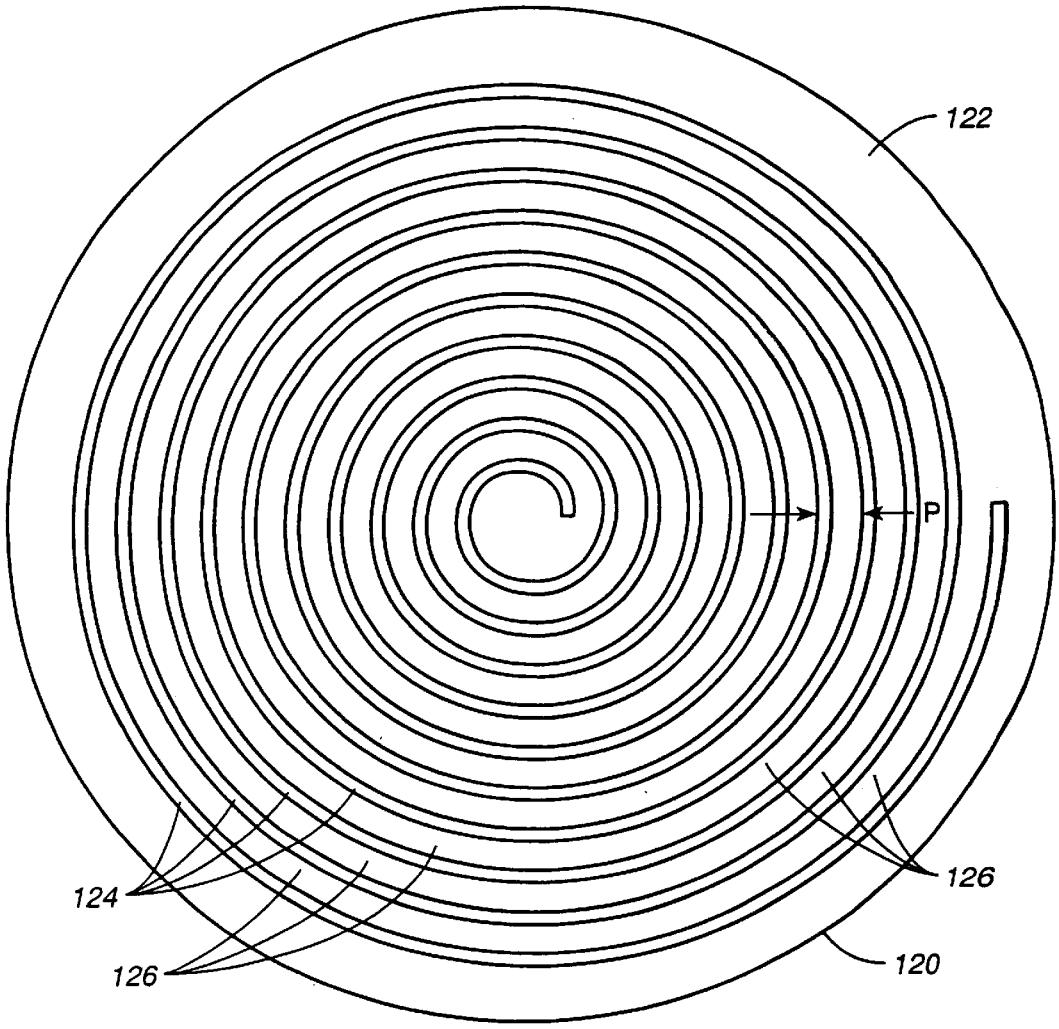
FIG. 5 is a schematic top view of a polishing pad using a spiral groove.

Referring to FIG. 5, in another embodiment, a spiral groove 124 is disposed in a polishing surface 122 of a polishing pad 120. Advantageously, the groove is uniformly spaced with a pitch P. A spiral partition 126 separates the rings of the spiral. Spiral groove 124 and spiral partition 126 may have the same dimensions as circular groove 104 and circular partition 106 of FIG. 3. That is, spiral groove 124 may have depth of at least about 0.02 inches, a width of at least about 0.015 inches, and a pitch of at least about 0.09 inches. Specifically, spiral groove 124 may have a depth between 0.02 and 0.05 inches, such as 0.03 inches, a width between about 0.015 and 0.40 inches, such as 0.20 inches, and a pitch P between about 0.09 and 0.24 inches, such as 0.12 inches.

Figure 7:
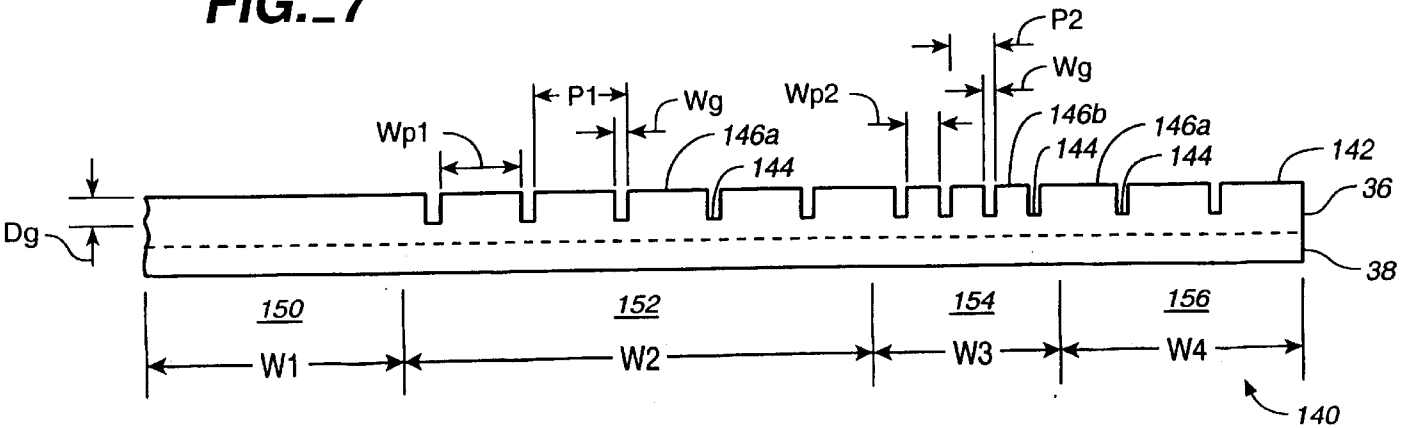
FIG. 7 is a cross-sectional view of the polishing pad of FIG. 6 along line 7—7.
Figure 6:
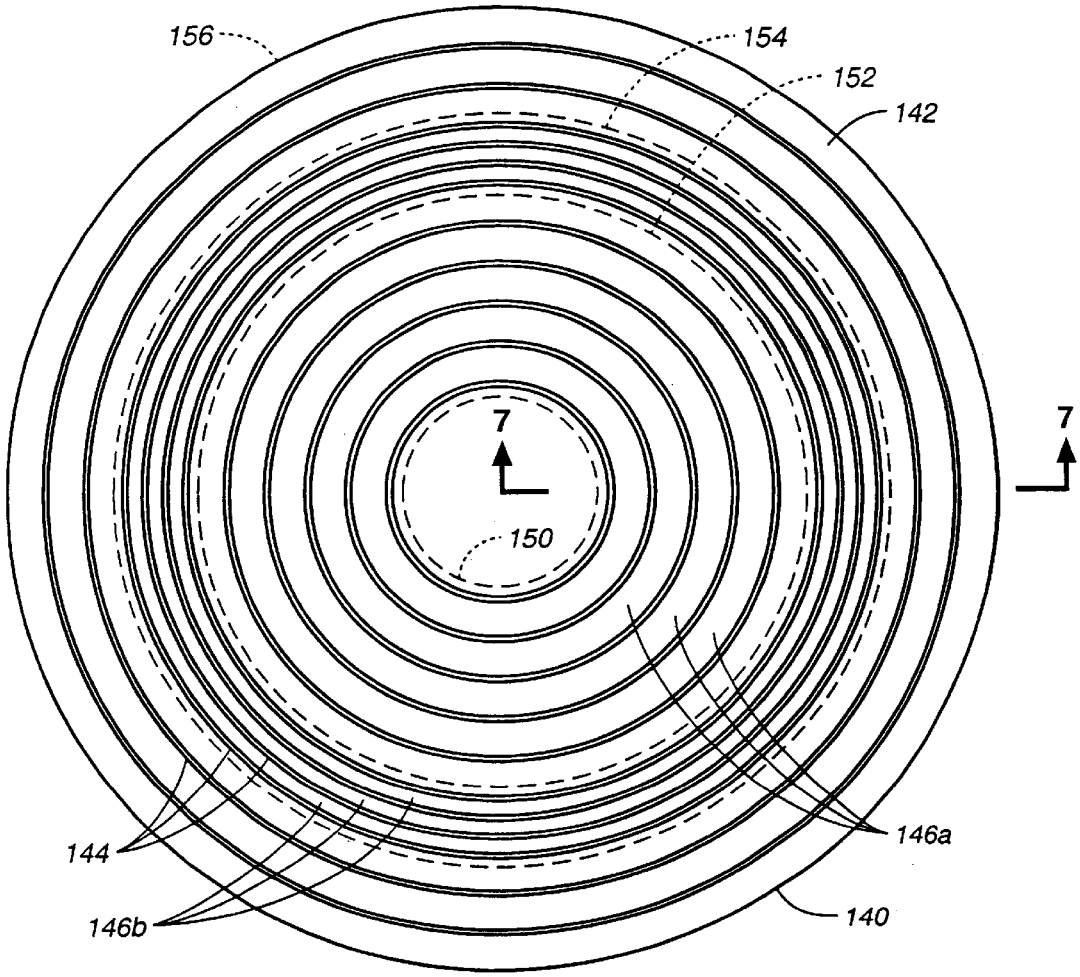
FIG. 6 is a schematic top view of a polishing pad having regions of different groove spacing.

Referring to FIGS. 6 and 7, in another embodiment, a plurality of concentric circular grooves 144 are disposed in a polishing surface 142 of a polishing pad 140. However, these grooves are not uniformly spaced. Rather, polishing surface 142 is partitioned into regions in which the grooves are spaced apart with different pitches. In addition, the grooves do not necessarily have a uniform depth.

In one implementation, polishing surface 142 is divided into four concentric regions including an innermost region 150, an annular outermost region 156 and two intermediate regions 152 and 154. Region 150 may be constructed without grooves, and the grooves in region 154 may be more closely spaced than the grooves in regions 152 and 156. Thus, the grooves in the region 154 are spaced apart with a pitch P2, whereas the grooves in regions 152 and 156 are spaced apart with a pitch P1, where P2 is less than P1. Each groove 144 may have a width Wg. The width Wg may be between about 0.015 and 0.04 inches, such as about 0.02 inches. The grooves may also have a uniform depth Dg of about 0.02 inches for a 0.05 inch thick upper layer 36, or about 0.03 inches for a 0.08 inch thick upper layer.

Between each groove in wide-pitch regions 152 and 156 is a wide annular partition 146*a* having a width Wp1, whereas between each groove in narrow-pitch region 154 is an narrow annular partition 146*b* having a width Wp2. Each wide partition 146*a* may have a width Wp1 between about 0.12 and 0.24 inches, such as about 0.18 inches. Accordingly, the pitch P1 between the grooves in the wide partition regions may be between about 0.09 and 0.24 inches, such as 0.2 inches. Thus, pitch P1 may be about twice as large as pitch P2. The surface area presented by wide partitions 146*a* is about 90% of the available surface area of the wide partition regions.

As previously noted, the grooves in region 154 may be spaced closer together. Each narrow partition 146*b* may have a width Wp2 between about 0.04 and 0.12 inches, such as about 0.08 inches. Accordingly, the pitch P2 between the grooves in the narrow partition region may be between about 0.045 and 0.2 inches, such as 0.10 inches. The surface area presented by narrow partitions 146*b* is about 75% of the available surface area of the narrow partition region.

Polishing pad 140 is particularly suited to reduce polishing uniformity problems, such as the so-called "fast band" effect. The fast band effect tends to appear in oxide polishing using a two-layer polishing pad with an SS12 slurry containing fumed silicas. The fast band effect causes an annular region of the substrate, the center of which is located approximately 15 millimeters from the substrate edge, to be significantly over-polished. This annular region may be about 20 millimeters wide. If polishing pad 140 is constructed to counter the fast band effect, the first region 150 may have a radius W1 of about 3.2 inches, the second region 152 may have a width W2 of about 4.8 inches, the third region 154 may have a width W3 of about 1.2 inches, and the fourth region 156 may have a width W4 of about 0.8 inches. These widths assume that the polishing pad is about 20 inches in diameter, and that the substrate will be moved across the polishing pad surface with a sweep range of about 0.8 inches, so that the substrate will be about 0.2 inches from the edge of the pad at the outermost point of the sweep and about 1.0 inches from the center of the pad at the innermost point of the sweep.

It appears that the polishing rate is comparable to the percentage of polishing pad surface area that contacts the substrate during polishing. By providing the polishing pad with a region in which more surface area is occupied by the grooves, the polishing rate is reduced in that region. Specifically, the closely spaced grooves in region 154 decrease the polishing rate in the otherwise over-polished portions of the substrate. Consequently, the polishing pad compensates for the fast band effect and improves polishing uniformity.

Figure 8:
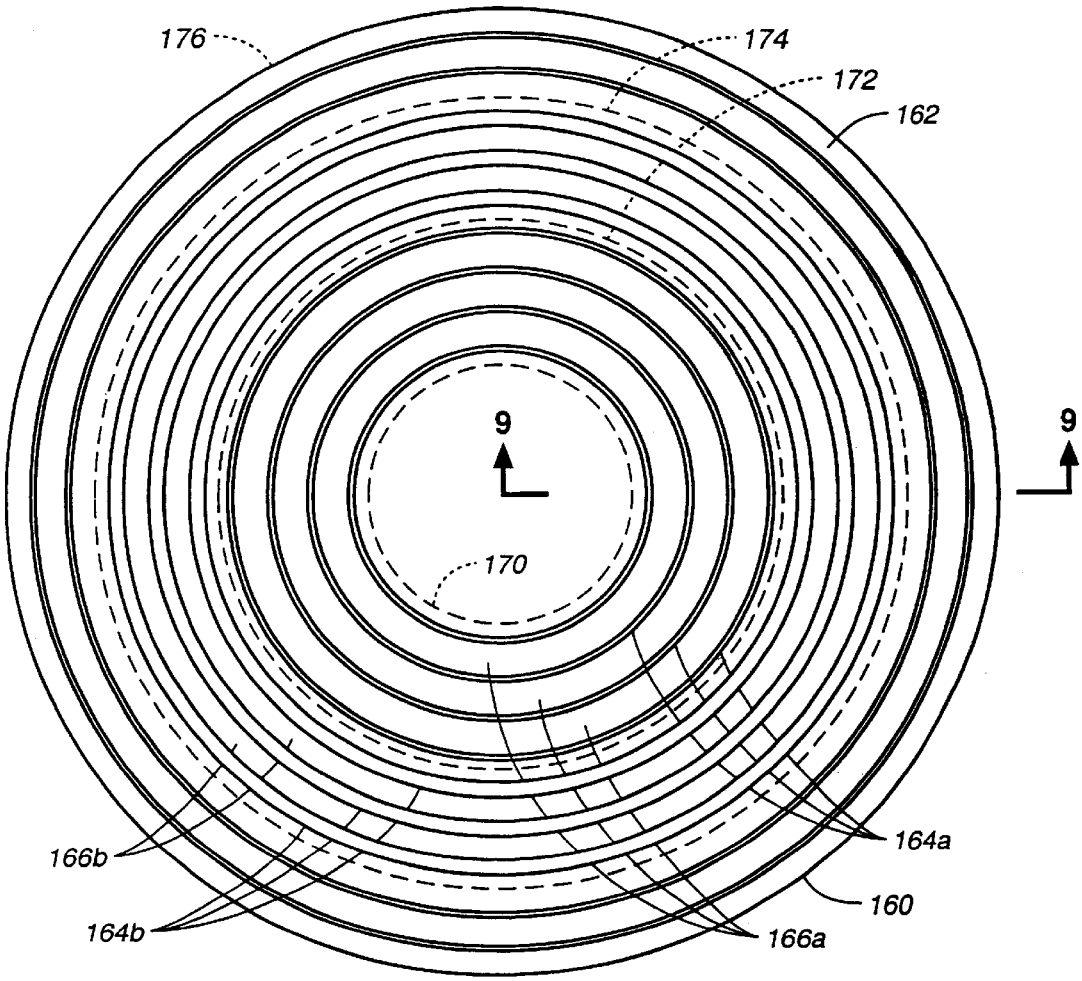
FIG. 8 is a schematic top view of a polishing pad having regions with different groove widths.
Figure 9:
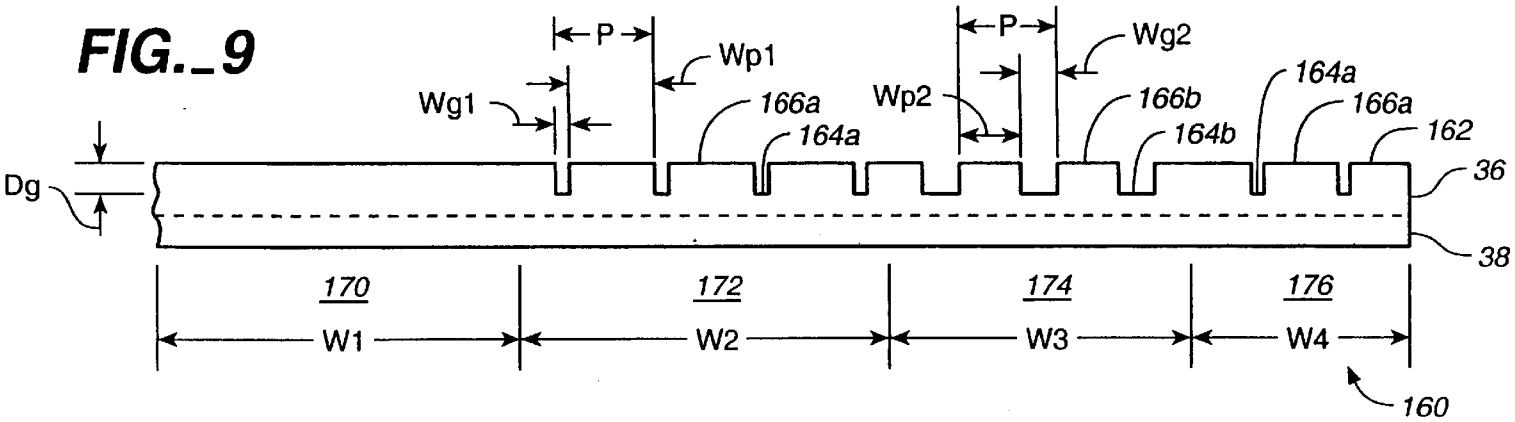
FIG. 9 is a cross-sectional view of the polishing pad of FIG. 8 along line 9—9.

In another embodiment, referring to FIGS. 8 and 9, a plurality of concentric circular grooves 164*a* and 164*b* are disposed in a polishing surface 162 of a polishing pad 160. These grooves 164*a* and 164*b* may be uniformly spaced with a pitch P. However, the grooves do not have a uniform width.

In one implementation, polishing surface 162 is divided into four concentric regions, including an innermost region 170, an outermost region 176, and two intermediate regions 172 and 174. Region 170 may be constructed without grooves, and the grooves 164*b* in region 174 may be wider than the grooves 164*a* in regions 172 and 176. The narrow grooves 164*a* may have a width Wg1 whereas the wide grooves 164*b* may have a width Wg2. Between each narrow groove 164*a* is a wide annular partition 166*a* having a width Wp1, whereas between each wide groove 164*b* is a narrow annular partition 166*b* having a width Wp2.

The wide grooves may be approximately two to twenty times, e.g., six times, wider than the narrow grooves. The narrow grooves 164*a* may have a width Wg1 between about 0.015 and 0.04 inches, such as 0.02 inches, whereas the wide grooves 164*b* may have a width Wg2 between about 0.04 and 0.3 inches, such as 0.125 inches. The wide partitions 166*a* may have a width Wp1 of between about 0.10 and 0.385 inches, such as 0.18 inches, whereas the narrow partitions 166*b* may have a width Wp2 between about 0.05 and 0.10 inches, such as 0.075 inches. The grooves may be evenly spaced with a pitch P between about 0.09 and 0.40 inches, such as 0.2 inches. In the narrow groove regions 172 and 176, the partitions cover about 75% of the available surface area whereas in the wide-grooved region 174 the partitions cover about 50% of the available surface area.

It should be noted that a variety of groove widths and/or spacings may be used to achieve the desired contact surface area. The key factor is that there be less surface area to contact the portions of the substrate which would otherwise be overpolished. A polishing pad having nonuniform groove spacings and widths may also be useful in processes in which nonuniform polishing of a substrate is desired.

Figure 11:
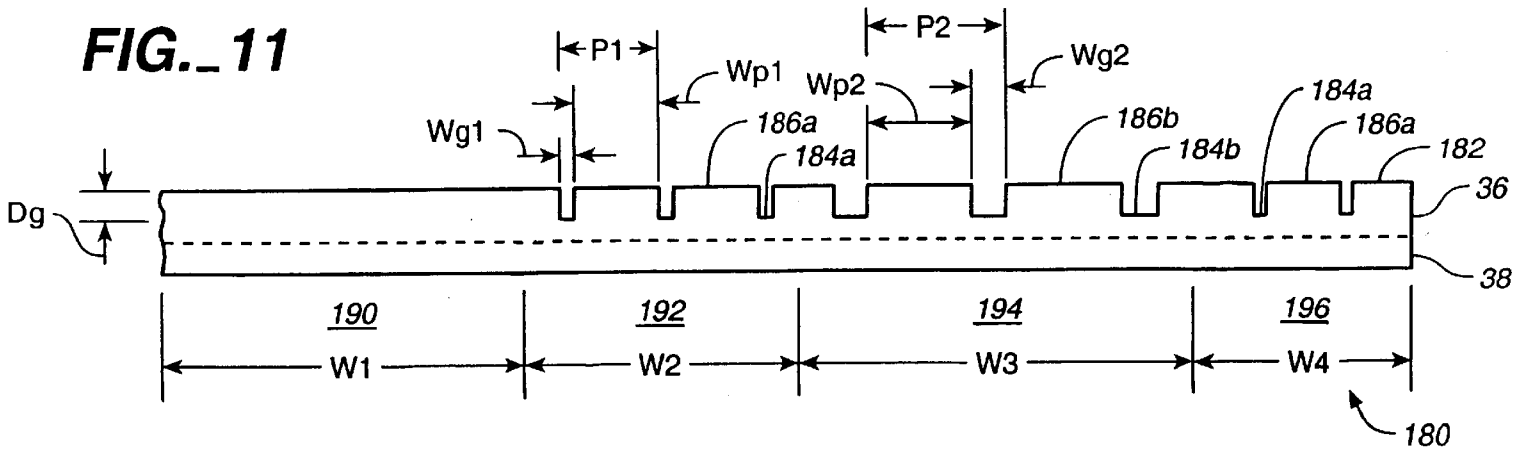
FIG. 11 is a cross-sectional view of the polishing pad of FIG. 10 along line 11—11.
Figure 10:
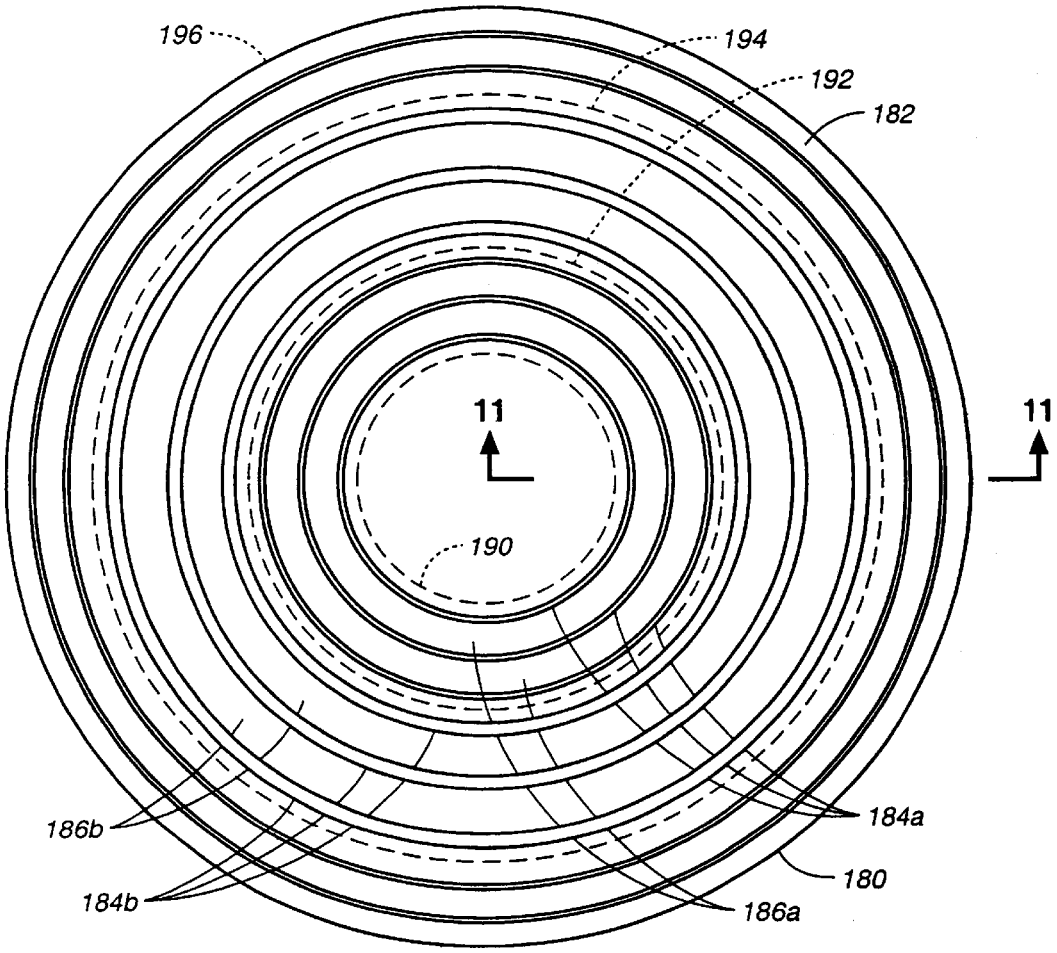
FIG. 10 is a schematic top view of a polishing pad having regions with different groove widths and different groove spacing.

In another embodiment, referring to FIGS. 10 and 11, a plurality of concentric circular grooves 184*a* and 184*b* are disposed in a polishing surface 184 of a polishing pad 180. These grooves 184*a* and 184*b* have both a non-uniform pitch and a non-uniform width.

In one implementation, polishing surface 182 is divided into four concentric regions, including an innermost region 190, an outermost region 196, and two intermediate regions 192 and 194. Region 190 may be constructed without grooves, and grooves 184*b* in region 194 may be wider but spaced farther apart than grooves 184*a* in regions 192 and 196. The narrow grooves 184*a* may have a width Wg1 of about 0.02 inches, whereas wide grooves 184*b* may have a width Wg2 of about 0.125 inches. The narrow grooves 184*a* may be disposed with a pitch P1 of about 0.12 inches, whereas wide grooves 184*b* in region 194 may be disposed with a pitch P2 of about 0.2 inches. Between each narrow groove 184*a* is an annular partition 186*a* having a width Wp1 of about 0.1 inches, whereas between each wide groove 184*b* is a annular partition 186*b* having a width Wp2 of about 0.075 inches.

Figure 12:
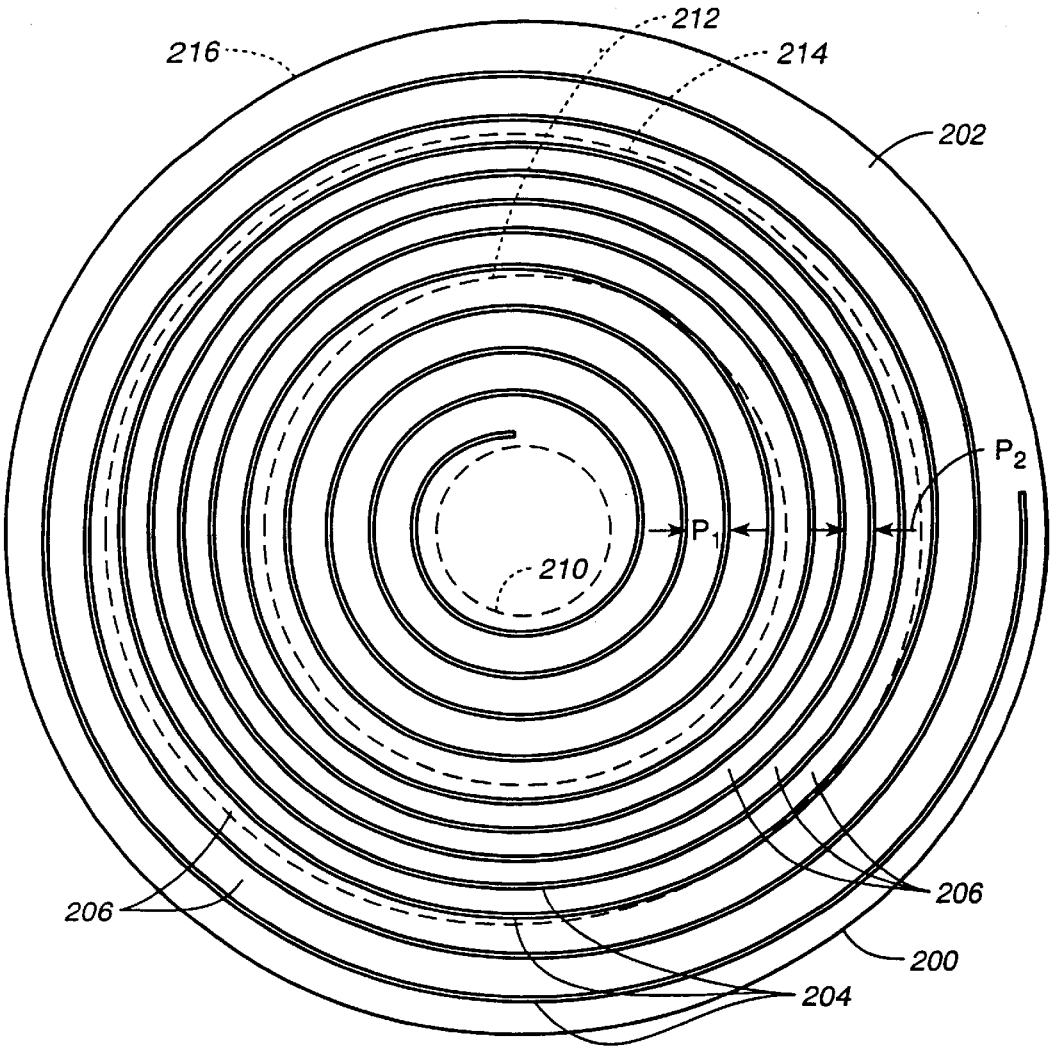
FIG. 12 is a schematic top view of a polishing pad having a spiral groove and regions of different groove pitch.

Referring to FIG. 12, in another embodiment, a spiral groove 204 is disposed in a polishing surface 202 of a polishing pad 200. A spiral partition 206 separates the rings of the spiral. The groove 204 has a non-uniform pitch. The width of groove 204 may be uniform or nonuniform.

Polishing surface 202 may be divided into four concentric regions, including an innermost region 210, an outermost region 216, and two intermediate regions 212 and 214. In region 214 the spiral groove has a narrower pitch than in regions 212 and 216. Specifically, spiral groove 204 may have a pitch P1 of about 0.20 inches in regions 212 and 216, and a pitch P2 of about 0.12 inches in region 214. Spiral groove 204 does not extend into region 210.

Figure 13:
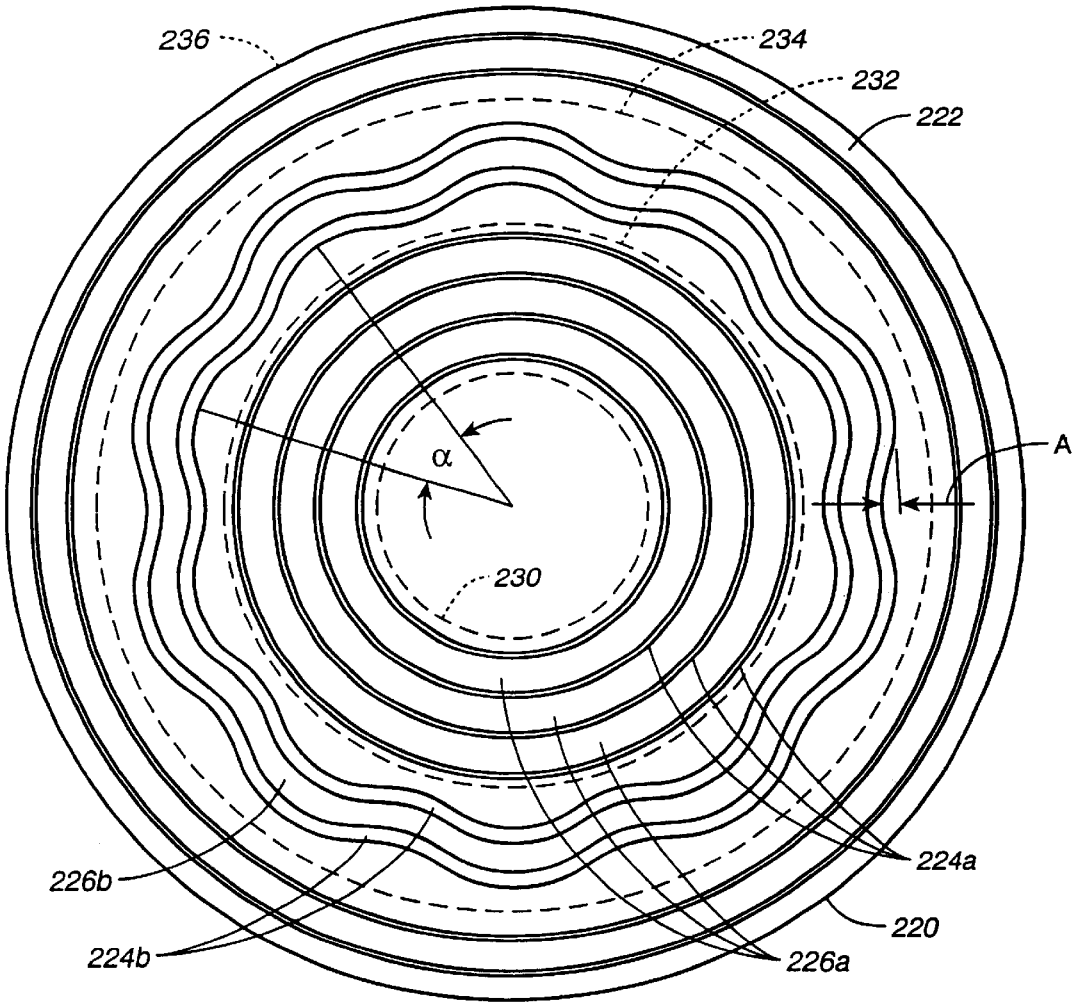
FIG. 13 is a schematic top view of a polishing pad having concentric circular grooves and serpentine grooves.

Referring to FIG. 13, in another embodiment, a plurality of concentric circular grooves 224*a* and a plurality of serpentine grooves 224*b* are disposed in a polishing surface 224 of a polishing pad 220. Serpentine grooves 224*b* may be wider than circular grooves 224*a*. Between each circular groove 224*a* is an annular partition 226*a*, whereas between each serpentine groove 224*b* is a serpentine partition 226*b*. Although not illustrated, some of the serpentine grooves 224*b* may intersect some of the circular grooves 224*a*.

Polishing surface 222 may be divided into four concentric regions, including an innermost region 230, an outermost region 236, and two intermediate regions 232 and 234. Region 230 may be constructed without grooves, whereas serpentine grooves may be located in region 234, and circular grooves may be located in regions 232 and 236. Circular grooves 224*a* may be constructed with a width of about 0.02 inches and a pitch of about 0.12 inches. Each serpentine grooves 224*b* may undulate between its innermost an outermost radius with an amplitude A of about 0.1 to 0.5 inches, such as 0.2 or 0.4 inches. Each undulation of a serpentine groove may extend through an angle a between about 5 and 180 degrees, such as 15 degrees. Thus, each serpentine grooves 224*b* may have between about 2 and 72, e.g., 24, undulations. The serpentine grooves 224*b* may have a width of about 0.125 inches and a pitch of about 0.20 inches. The second pitch of serpentine grooves 224 may be between about one and two times their amplitude, or between about one-and-one-half and two times their second width.

In an exemplary polishing pad, region 232 may extend from a radius of about 3.2 inches to a radius of about 8.0 inches, region 234 may extend from a radius of about 8.0 inches to a radius of about 9.2 inches, and region 236 may extend from a radius of about 9.2 inches to a radius of about 9.92 inches.

Figure 14:
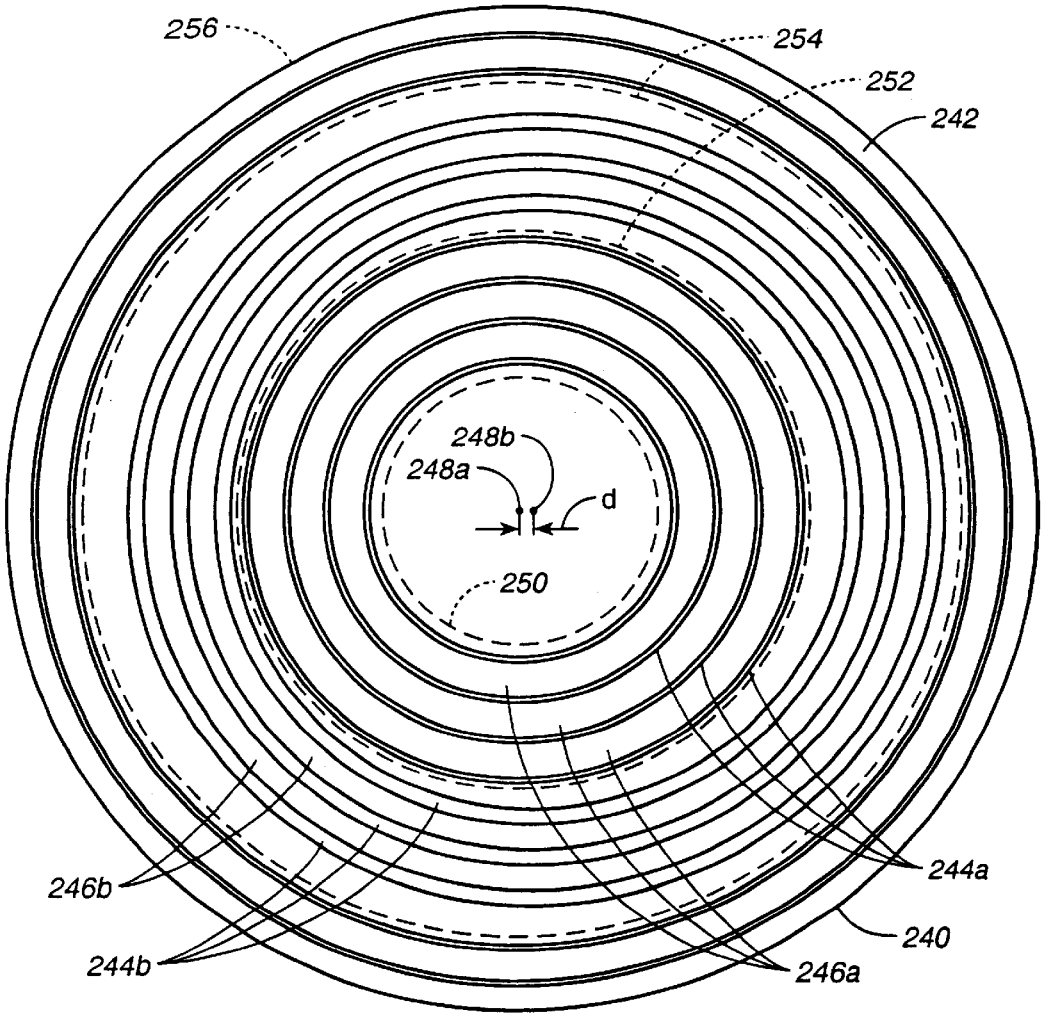
FIG. 14 is a schematic top view of a polishing pad having circular grooves with different radial centers.

Referring to FIG. 14, in still another embodiment, circular grooves 244*a* and 244*b* are disposed in a polishing surface 242 of a polishing pad 240. These grooves have non-uniform widths. In addition, grooves 244*a* are concentric about a point 248*a*, whereas grooves 224*b* are concentric about a different point 248*b*. Grooves 244*a* are separated by annular partitions 246*a*, whereas grooves 244*b* are separated by annular partitions 246*b*. The center points 248*a* and 248*b* may be separated by a distance d approximately equal to the pitch between grooves 244*b*. Although not illustrated, some of the circular grooves 244*a* may intersect some of the circular grooves 244*b*.

Polishing surface 242 is divided into four concentric regions including an innermost region 250, an outermost region 256, and two intermediate regions 252 and 254. The grooves in regions 252 and 256 are concentric about point 248*a*, whereas the grooves in region 254 are concentric about point 248*b*. Grooves 244*a* and 244*b* may have widths of 0.02 and 0.125, respectively, and pitches of 0.20 and 0.24, respectively.

Figure 15:
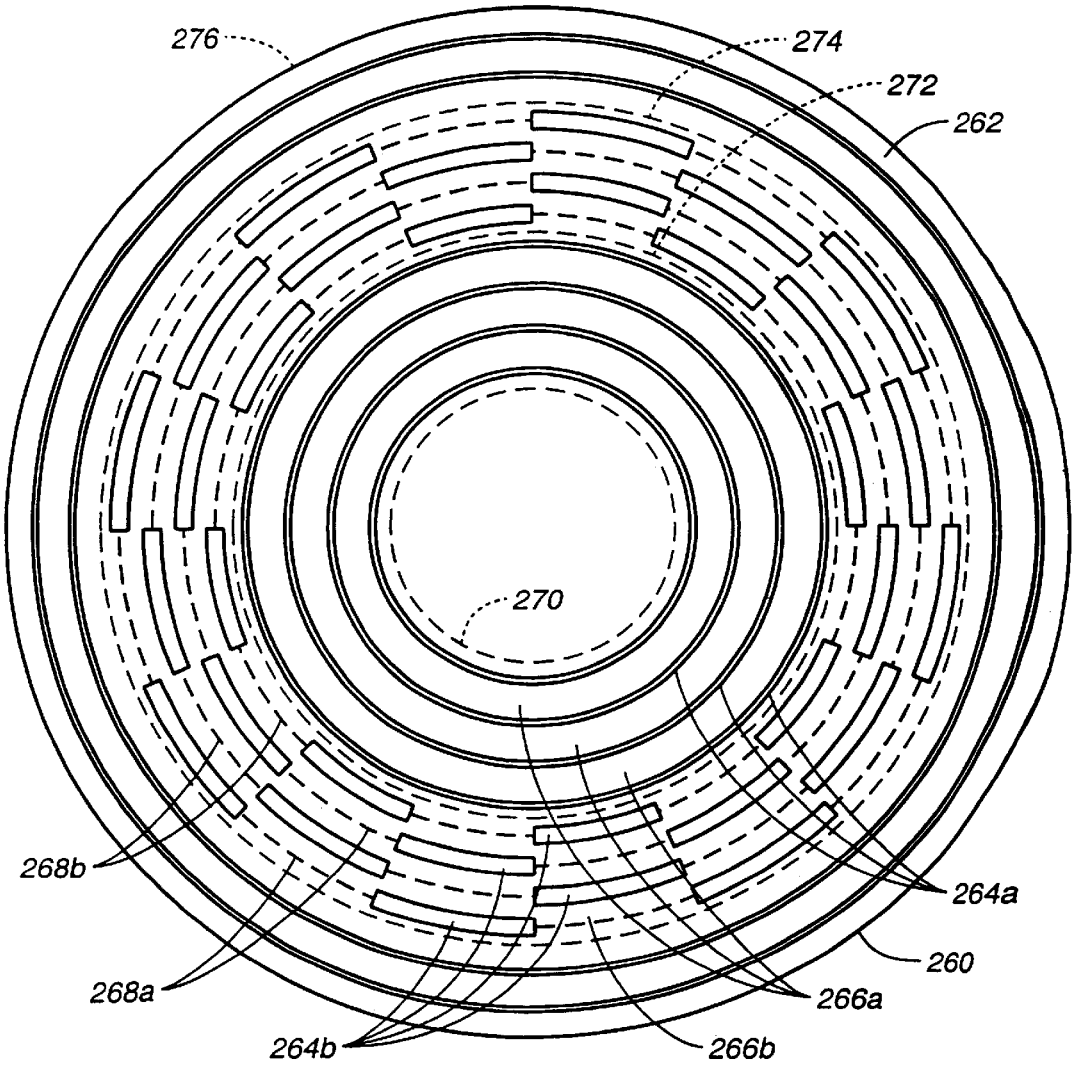
FIG. 15 is a schematic top view of a polishing pad having concentric circular grooves and groove arc segments.

Referring to FIG. 15, in yet another embodiment, a plurality of concentric circular grooves 264*a* and a plurality of segmented groove arcs 264*b* are formed in a polishing surface 262 of a polishing pad 260. The segmented groove arcs 264*b* are disposed along adjacent concentric circular paths 268*a* and 268*b*. The arcs may be offset so that the arcs on paths 268*a* are not adjacent to the arcs on paths 268*b*. An annular partition 266*a* separates each circular groove 264*a*, whereas a single partition 266*b* encompasses groove arcs 264*b*.

Polishing surface 262 may be divided into four concentric regions, including an innermost region 270, an outermost region 276, and two intermediate regions 272 and 274. Region 270 may be constructed without grooves, whereas groove arcs 264*b* may be located in region 274 and circular grooves 264*a* may be located in regions 272 and 276. Circular grooves 264*a* may have a width of about 0.02 inches and a pitch of about 0.20 inches. Groove arcs 264*b,* may have a width of about 0.125 inches, and circular paths 268*a* and 268*b* may be spaced apart by about 0.2 inches. In this embodiment, the pitch may be considered as the between adjacent circular paths.

Figure 16:
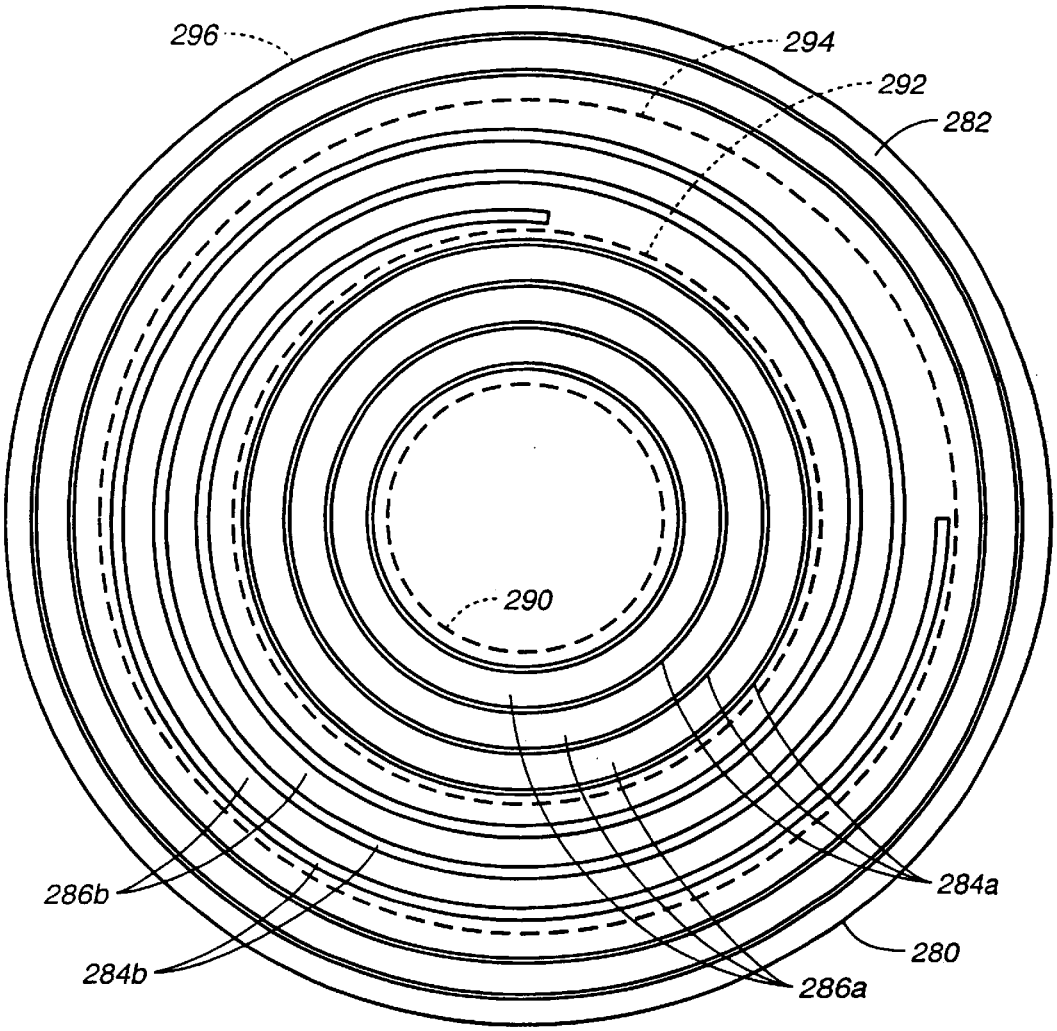
FIG. 16 is a schematic top view of a polishing pad having both concentric circular grooves and a spiral groove.

Referring to FIG. 16, in still another embodiment, a plurality of concentric circular grooves 284*a* and a spiral groove 284*b* are formed in a polishing surface 282 of a polishing pad 280. An annular partition 286*a* separates each circular groove 284*a,* whereas spiral groove 284*b* defines a spiral partition 286*b.*

Polishing surface 282 may be divided into four concentric regions, including an innermost region 290, an outermost region 296, and two intermediate regions 292 and 294. Region 290 may be constructed without grooves, whereas spiral groove 284*b* may be located in region 294 and circular grooves 284*a* may be located in regions 292 and 296. Circular grooves 284*a* may be constructed similarly to circular grooves 264*a,* i.e., with a width of about 0.02 inches and a pitch of about 0.12 inches. Spiral groove 284*b* may have a width of about 0.125 inches, and a pitch of about 0.2 inches. In an exemplary polishing pad, region 282 may extend from a radius of about 3.2 inches to a radius of about 7.88 inches, region 284 may extend from a radius of about 8.0 inches to a radius of about 9.2 inches, and region 286 may extend from a radius of about 9.32 inches to a radius of about 9.92 inches.

In addition, in all of the embodiments, there may be gradients of groove width and/or partition width between adjacent regions. These gradients provide polishing at rates intermediate to the rates in the adjacent regions. Since the substrate is oscillated across the polishing pad surface, the intermediate polishing rates will provide more uniform polishing between adjacent areas of the substrate.

The grooves of the embodiments described above provide air channels which reduce any vacuum build-up between the polishing pad and the substrate. However, as the surface area available for polishing decreases, an accompanying increase in the polishing time may be required to achieve the same polishing results.

The grooves may be formed in the polishing surface by cutting or milling. Specifically, a saw blade on a mill may be used to cut grooves in the polishing surface. Alternatively, grooves may be formed by embossing or pressing the polishing surface with a hydraulic or pneumatic press. The relatively simple groove pattern avoids expensive machining. Also, the grooves may be formed by preparing the polishing pad in a mold. For example, the grooves may be formed during a polymerization reaction in which the polishing pad is cast from a mold which contains a negative image of the grooves.

As was described above, the slurry/rinse arm provides slurry to the polishing surface. The continuous channels formed in the polishing pad facilitate the migration of slurry around the polishing pad. Thus, excess slurry in any region of the pad may be transferred to another region by the groove structure, providing more uniform coverage of slurry over the polishing surface. Accordingly, the distribution of slurry is improved and any variations in the polishing rate attributable to poor slurry distribution will be reduced.

In addition, the grooves reduce the possibility that waste materials generated during the polishing and conditioning cycles will interfere with slurry distribution. The grooves facilitate the migration of waste materials away from the polishing pad surface, reducing the possibility of clogging. The width of the grooves permits a spray rinse from slurry/rinse arm 52 to effectively flush the waste materials from the grooves.

The depth of the grooves improves polishing pad lifetime. As discussed above, the conditioning process abrades and removes material from the surface of the polishing pad, thereby reducing the depth of the grooves. Consequently, the lifetime of the pad may be increased by increasing the groove depth.

The invention is not limited to the embodiment depicted and described. Rather, the scope of the invention is defined by the appended claims.

What is claimed is:

1. A polishing pad for polishing a substrate in a chemical mechanical polishing system, comprising:

a layer having a thickness between about 0.06 and 0.12 inches, one side of the layer providing a polishing surface and having a plurality of grooves formed therein, the grooves having a depth between about 0.02 and 0.05 inches and being uniformly spaced over the polishing surface.

2. The polishing pad of claim 1, wherein the grooves have a depth of approximately 0.03 inches.

3. The polishing pad of claim 1, wherein the grooves have a width between about 0.015 and 0.04 inches.

4. The polishing pad of claim 3, wherein the grooves have a width of approximately 0.02 inches.

5. The polishing pad of claim 1, wherein the grooves have a pitch between about 0.09 and 0.24 inches.

6. The polishing pad of claim 5, wherein the grooves have a pitch of approximately 0.12 inches.

7. The polishing pad of claim 2, wherein the grooves are concentrically arranged circles.

8. The polishing pad of claim 1, wherein the polishing pad further comprises a lower layer on a side of the layer opposite the polishing surface.

9. The polishing pad of claim 8, wherein a distance between a bottom of the grooves and the lower layer is between about 0.035 and 0.085 inches.

10. The polishing pad of claim 9, wherein the distance between a bottom of the grooves and the lower layer is about 0.04 inches.

11. The polishing pad of claim 8, wherein the thickness of the layer of is about 0.07 inches.

12. A method of polishing, comprising:

bringing a substrate into contact with a polishing pad having a layer with a thickness between about 0.06 and 0.12 inches, one side of the layer providing a polishing surface and having a plurality of grooves formed therein, the grooves having a depth between about 0.02 and 0.05 inches and being uniformly spaced over the polishing surface;

causing relative motion between the substrate and the polishing surface; and supplying a polishing liquid to the polishing surface so that the grooves distribute the polishing liquid to the substrate.

* * * * *

US006699115C1

(12) EX PARTE REEXAMINATION CERTIFICATE (9686th)

United States Patent

Osterheld et al.

(10) Number: US 6,699,115 C1

(45) **Certificate Issued: *May 31, 2013**

(54) POLISHING PAD HAVING A GROOVED PATTERN FOR USE IN A CHEMICAL MECHANICAL POLISHING APPARATUS

(75) Inventors: Thomas H Osterheld, Mountain View, CA (US); Sen-Hou Ko, Sunnyvale, CA (US)

(73) Assignee: Applied Materials, Inc., Santa Clara, CA (US)

Reexamination Request:
No. 90/010,108, Mar. 12, 2008

Reexamination Certificate for:

| | |
|---|---|
| Patent No.: | **6,699,115** |
| Issued: | **Mar. 2, 2004** |
| Appl. No.: | **10/330,876** |
| Filed: | **Dec. 24, 2002** |

( * ) Notice: This patent is subject to a terminal disclaimer.

Related U.S. Application Data

(60) Continuation of application No. 10/040,108, filed on Oct. 29, 2001, now Pat. No. 6,520,847, which is a continuation of application No. 09/441,633, filed on Nov. 16, 1999, now Pat. No. 6,645,061, which is a division of application No. 09/003,315, filed on Jan. 6, 1998, now Pat. No. 5,984,769, which is a continuation-in-part of application No. 08/856,948, filed on May 15, 1997, now Pat. No. 5,921,855.

(51) Int. Cl.

| | |
|---|---|
| ***B24B 37/04*** | (2006.01) |
| ***B24D 13/14*** | (2006.01) |
| ***B24D 13/00*** | (2006.01) |

(52) U.S. Cl.
USPC ..... 451/527; 451/41; 451/529; 451/550

(58) Field of Classification Search
None
See application file for complete search history.

(56) References Cited

To view the complete listing of prior art documents cited during the proceeding for Reexamination Control Number 90/010,108, please refer to the USPTO's public Patent Application Information Retrieval (PAIR) system under the Display References tab.

*Primary Examiner* — Peter C. English

(57) ABSTRACT

A polishing pad for a chemical mechanical polishing apparatus. The polishing pad includes a plurality of concentric circular grooves. The polishing pad may include multiple regions with grooves of different widths and spacings.

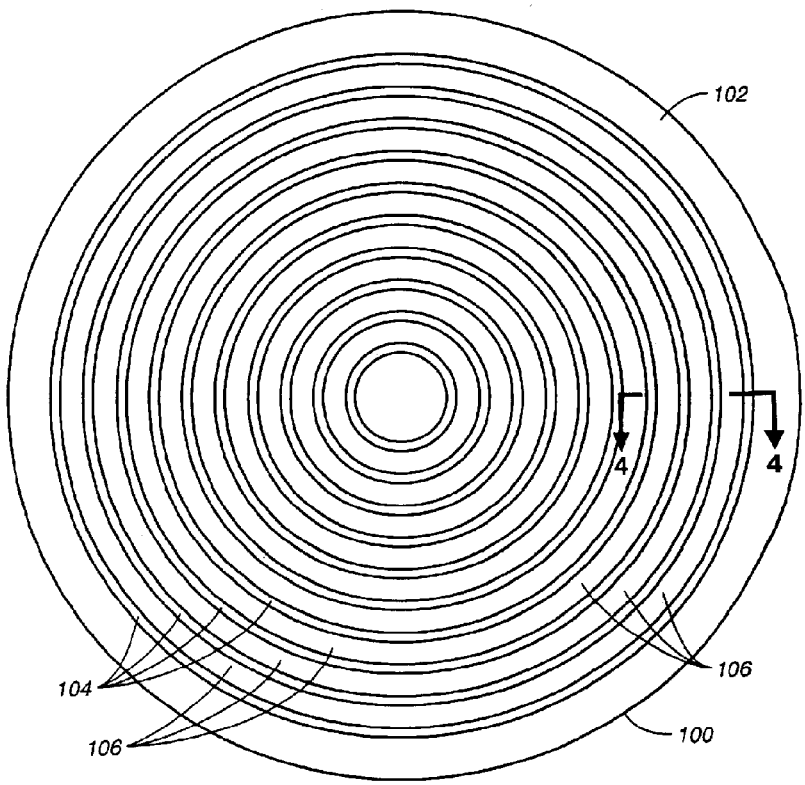

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *